US007185439B1

(12) United States Patent
Nubin et al.

(10) Patent No.: US 7,185,439 B1
(45) Date of Patent: Mar. 6, 2007

(54) SYSTEM FOR MEASURING THE POSITION OF A BALL IN A SPORTING EVENT

(76) Inventors: Rodney T. Nubin, 1 Farmington Ct., South Elgin, IL (US) 60177; Joe Nubin, 1 Farmington Ct., South Elgin, IL (US) 60177

( * ) Notice: Subject to any disclaimer, the term of this patent is extended or adjusted under 35 U.S.C. 154(b) by 0 days.

(21) Appl. No.: 11/328,390

(22) Filed: Jan. 9, 2006

(51) Int. Cl.
*G01B 11/26* (2006.01)
*G01C 15/00* (2006.01)

(52) U.S. Cl. ..... 33/289; 473/490

(58) Field of Classification Search ..... 33/289, 33/286, 281–282, 227, DIG. 21; 473/415, 473/438, 470, 490
See application file for complete search history.

(56) References Cited

U.S. PATENT DOCUMENTS 3,752,588 A 8/1973 Chapman
4,090,708 A 5/1978 McPeak
5,214,491 A 5/1993 Snowden
6,778,283 B2 * 8/2004 Lee et al. ..... 33/289
6,851,198 B1 * 2/2005 Harty ..... 33/289
6,895,677 B2 * 5/2005 Dinicola ..... 33/289
6,907,840 B1 * 6/2005 Gaines ..... 33/289
6,976,928 B2 * 12/2005 Hemphill ..... 473/490
2004/0111903 A1 * 6/2004 Amron ..... 33/289
2004/0111905 A1 * 6/2004 Amron et al. ..... 33/289
2005/0183273 A1 * 8/2005 Amron et al. ..... 33/289

* cited by examiner

*Primary Examiner*—Yaritza Guadalupe McCall

(57) ABSTRACT

A sporting apparatus for use in football. The sporting apparatus is a system that measures the manner in which football downs and distance is calculated in football. The system includes two down markers, a ball marker, and a hand held device which are in visual contact with each other through a series of radio wave or light wave communications. The system eliminates the need for the traditional down markers used in today's football games in which distance must be frequently checked manually.

20 Claims, 1 Drawing Sheet

SYSTEM FOR MEASURING THE POSITION OF A BALL IN A SPORTING EVENT

BACKGROUND OF THE INVENTION

1. Field of the Invention

The present invention concerns that of a new and improved sporting apparatus for use in football.

2. Description of the Prior Art

U.S. Pat. No. 5,214,491, issued to Snowden, discloses a device comprised of a ramp of the length that is equal to a first down and includes a sighting laser at each end and a spotting laser that moves along the length for determining the position of a football.

U.S. Pat. No. 4,090,708, issued to McPeak, discloses a device for marking football fields using a laser.

U.S. Pat. No. 3,752,588, issued to Chapman, discloses the use an optical laser measuring device for determining the distance for a first down.

SUMMARY

The present invention concerns that of a new and improved sporting apparatus for use in football. The sporting apparatus is a system that measures the manner in which football downs and distance is calculated in football. The system includes two down markers, a ball marker, and a hand held device which are in visual contact with each other through a series of radio wave or light wave communications. The system eliminates the need for the traditional down markers used in today's football games in which distance must be frequently checked manually.

There has thus been outlined, rather broadly, the more important features of a sporting apparatus for use in football that the detailed description thereof that follows will be better understood and in order that the present contribution to the art will be better appreciated. There are, of course, additional features of the sporting apparatus for use in football that will be described hereinafter and which will form the subject matter of the claims appended hereto.

In this respect, before explaining at least one embodiment of the sporting apparatus for use in football in detail, it is to be understood that the sporting apparatus for use in football is not limited in its application to the details of construction and to the arrangements of the components set forth in the following description or illustrated in the drawings. The sporting apparatus for use in football is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present sporting apparatus for use in football. It is important, therefore, that the claims be regarded as including such equivalent constructions insofar as they do not depart from the spirit and scope of the present invention.

It is therefore an object of the present invention to provide a sporting apparatus for use in football which has all of the advantages of the prior art and none of the disadvantages.

It is another object of the present invention to provide a sporting apparatus for use in football which may be easily and efficiently manufactured and marketed.

It is another object of the present invention to provide a sporting apparatus for use in football which is of durable and reliable construction.

It is yet another object of the present invention to provide a sporting apparatus for use in football which is economically affordable and available for relevant market segment of the purchasing public.

Other objects, features and advantages of the present invention will become more readily apparent from the following detailed description of the preferred embodiment when considered with the attached drawings and appended claims.

DETAILED DESCRIPTION OF THE PREFERRED EMBODIMENTS

Figure 1:
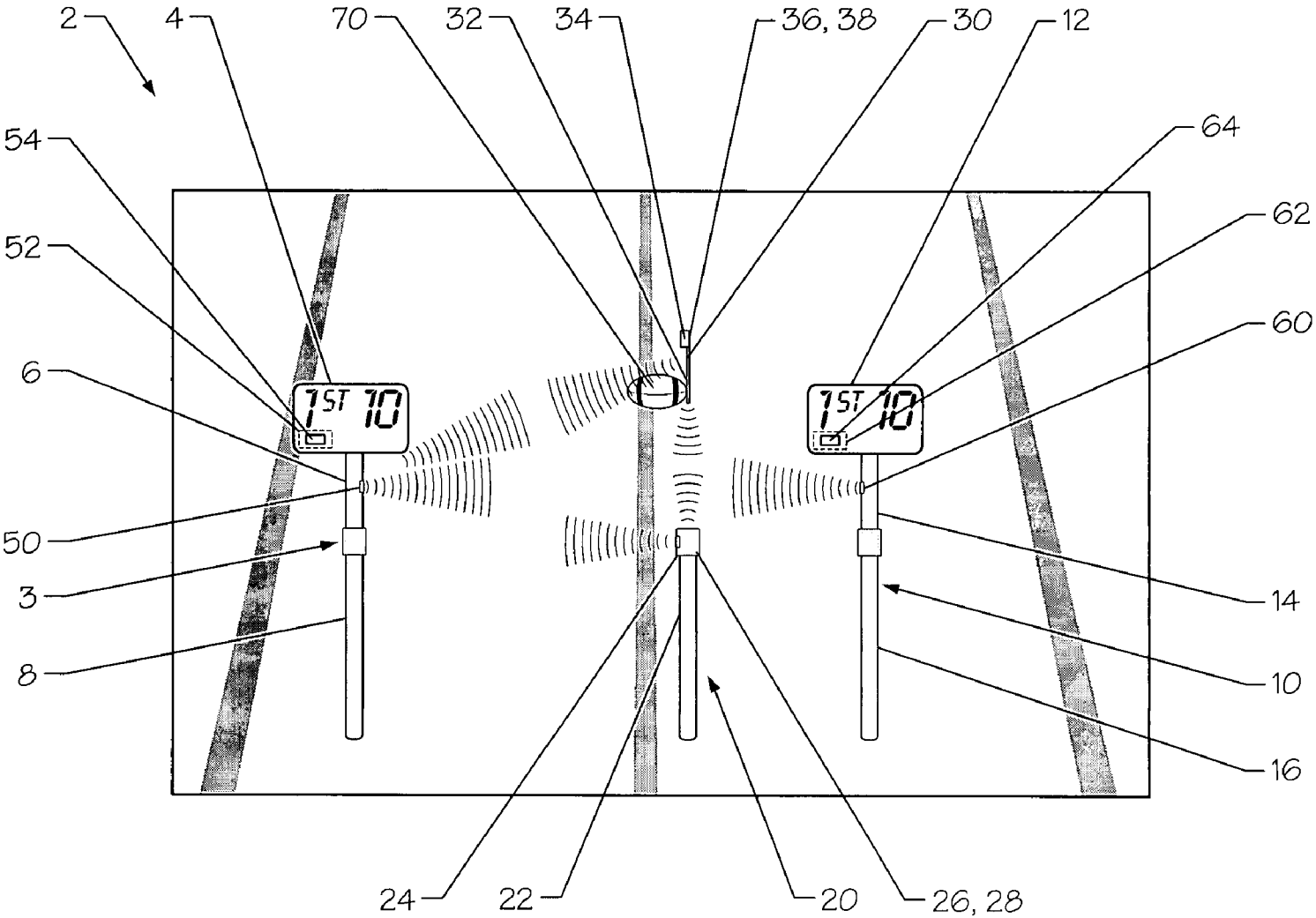
FIG. 1 is a front representational view illustrating a sporting apparatus for use in football, constructed in accordance with the present invention.

FIG. 1 shows a front representational view of the sporting apparatus 2 for use in football. The sporting apparatus 2 is a system that measures the manner in which football downs and distance is calculated in football. The apparatus 2 includes two down markers 3 and 10, a ball marker 22, and a computer unit 24 which are in electronic contact with each other through a series of radio wave or light wave communications. The system eliminates the need for the traditional down markers used in today's football games in which distance must be frequently checked manually.

The first down marker 3 comprises two poles, a first pole 6 and a second pole 8, with each of these poles having two ends, a top end and a bottom end. The bottom end of the first pole 6 is telescoping within the top end of the second pole 8 allowing the first down marker 3 to be height adjusted depending on the desires of the user. Means associated with the first pole 6 and the second pole 8 releasably secure the first pole 6 within the second pole 8 to maintain the desired height of the first down marker 3. Attached to the top end of the first pole 6 is a display unit 4.

The first down marker 3 also has a transmitter 50 that is preferably incorporated into the first pole 6 or the second pole 8. The transmitter 50 is capable of emitting either radio wave or light wave communications. The transmitter 50 is powered by power means 52, which preferably is at least one battery 54 located within the display unit 4.

The second down marker 10 comprises two poles, a first pole 14 and a second pole 16, with each of these poles having two ends, a top end and a bottom end. The bottom end of the first pole 14 is telescoping within the top end of the second pole 16 allowing the second down marker 10 to be height adjusted depending on the desires of the user. Means associated with the first pole 14 and the second pole 16 releasably secure the first pole 14 within the second pole 16 to maintain the desired height of the second down marker 10. Attached to the top end of the first pole 14 is a display unit 12.

The second down marker 10 also has a receiver 60 that is incorporated into the first pole 14. The receiver 60 is capable of receiving either radio wave or light wave communications that are emitted from the transmitter 50 and any other transmitting units of the apparatus 2. The receiver 60 is powered by power means 62, which preferably is at least one battery 64 located within the display unit 12.

A ball marker 20 is designed to mark the ball on the field of play. Ball marker 20 comprises a single pole 22 that has two ends, a top end and a bottom end, and also comprises a computer unit 24 attached to the top end of the pole 22. The ball marker 20 will not actually physically be on the actual field of play, but will be positioned between the first down marker 3 and second down marker 10 at the actual yardage corresponding to where the ball is located on the play field. After each play, the ball marker 20 will be adjusted to the new location that corresponds to where the ball is located on the play field. The computer unit 24 has incorporated receiver 26 and transmitter 28 units.

A hand held device 30 has two ends, a top end and a bottom end. Hand held device 30 comprises a single pole 32 that has two ends, a top end and a bottom end, and also comprises a computer unit 34 attached to the top end of the pole 32. The computer unit 34 has incorporated receiver 36 and transmitter 38 units.

When a referee or official needs a measurement, he will then proceed to locate the hand held device 30 where the football 70 is actually located. Then, the hand held device 30 will initiate a measurement between the ball marker 20 and the hand held device 30. The hand held device 30 will also measure the distance in between the hand held device 30 and the first down marker 3. Once these two distances are known, the computer unit 34 within the hand held device 30 will be able to calculate the third distance of the triangle, which is the distance in between the ball marker 20 and the first down marker 3.

Through this invention, a referee or official would be able to clearly determine whether a "first down" had been achieved. If the location of the ball, as measured by the ball marker, was at or beyond the location of the first down marker 3, then this goal had been achieved. If not, the ball marker 3 could be repositioned to the proper location that corresponds to where the ball is located on the play field.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A measuring system for sporting use, the measuring system comprising:

a first down marker, the first down marker comprising two poles, a first pole and a second pole, each pole having two ends, a first end and a second end, the second end of the first pole being telescoping within the first end of the second pole, a first display unit attached to the top end of the first pole, a transmitter incorporated into the first pole of the first down marker, the transmitter capable of emitting communication waves, a first power means for providing power to the first display unit and the transmitter, a second down marker, the second down marker comprising two poles, a first pole and a second pole, each pole having two ends, a first end and a second end, the second end of the first pole being telescoping within the first end of the second pole, a second display unit attached to the top end of the first pole, a receiver incorporated into the first pole of the second down marker, the receiver capable of receiving communication waves emitted from the transmitter, a second power means for providing power to the second display unit and the receiver, a ball marker unit comprising a pole, the pole having two ends, a top end and a bottom end, the ball maker further comprising a computer unit attached to the top end of the pole, the computer unit including receiver and transmitter units, the ball marker unit being positioned in between the first down marker and the second down marker, a hand held device comprising a pole, the pole having two ends, a top end and a bottom end, the hand held device further comprising a computer unit attached to the top end of the pole, the computer unit including receiver and transmitter units, the hand held device being placed onto a playing field, wherein an individual can utilizing the first down marker, the ball marker unit, and the hand held device to measure the position of a football in relation to the first down marker.

2. A measuring system for sporting use according to claim 1 wherein the first power means for providing power to the first display unit and the transmitter further comprises at least one battery, the battery being located within the first display unit.

3. A measuring system for sporting use according to claim 2 wherein the second power means for providing power to the second display unit and the receiver further comprises at least one battery, the battery being located within the second display unit.

4. A system for measuring the position of a ball in a sporting event, the system comprising:

a first marker;

a first display unit attached to the first marker;

a transmitter incorporated into the first marker, the transmitter capable of emitting communication waves;

a first power means for providing power to the first display unit and the transmitter;

a second marker;

a second display unit attached to the second marker;

a receiver incorporated into the second marker, the receiver capable of receiving communication waves emitted from the transmitter, a second power means for providing power to the second display unit and the receiver;

a ball marker unit having a computer unit, the computer unit having a receiver unit and a transmitter unit, the ball marker unit being positioned between the first marker and the second marker, a locating device having a computer unit, the computer unit including a receiver unit and a transmitter unit, the locating device being placed onto a playing field, wherein an individual utilizing the first marker, the ball marker unit, and the hand held device to measure the position of the ball in relation to the first marker.

5. The system of claim 4 wherein the first marker has a first pole and a second pole, each pole having a first end and a second end, the second end of the first pole being telescoping and releasably held within the first end of the second pole.

6. The system of claim 5 wherein the first display unit is attached to the first end of the first pole of the first marker.

7. The system of claim 5 wherein the transmitter is incorporated into the first pole of the first marker.

8. The system of claim 4 wherein the second marker has a first pole and a second pole, each pole having a first end and a second end, the second end of the first pole being telescoping and releasably held within the first end of the second pole.

9. The system of claim 8 wherein the second display unit is attached to the first end of the first pole of the second marker.

10. The system of claim 8 wherein the receiver is incorporated into the first pole of the second marker.

11. The system of claim 4 wherein the ball marker unit is a pole having a top end and a bottom end, the computer unit attached to the top end of the pole.

12. The system of claim 4 wherein the locating device is a hand held device.

13. The system of claim 12 wherein the hand held device is a pole having a top end and a bottom end, the computer unit attached to the top end of the pole.

14. The system of claim 4 wherein the first power means for providing power to the first display unit and the transmitter further comprises at least one battery, the battery being located within the first display unit.

15. The system of claim 4 wherein the second power means for providing power to the second display unit and the receiver further comprises at least one battery, the battery being located within the second display unit.

16. The system of claim 4 wherein the first and the second markers are down markers, wherein an individual utilizing the down markers, the ball marker unit, and the hand held device can measure the position of a football in relation to the down markers.

17. A method for measuring the position of a football between two markers, the method comprising:

providing a first marker;

providing a second marker;

positioning the second marker a predetermined distance from the second marker;

providing a ball marker unit;

positioning the ball marker unit between the first marker and the second marker;

providing a locating device;

positioning the locating device adjacent the football;

electronically communicating between the locating device, the ball marker unit, and the first and second markers to measure the position of the football at a point between the first and second markers.

18. The method of claim 17 and further comprising:

attaching a first display unit to the first marker;

incorporating a transmitter into the first marker;

emitting communication waves from the transmitter;

attaching a second display unit to the second marker;

incorporating a receiver into the second marker receiving communication waves emitted from the transmitter into the receiver.

19. The method of claim 17 wherein the first marker and the second marker are positioned ten yards apart from each other.

20. The method of claim 17 wherein the ball marker unit has a computer unit, a receiver unit, and a transmitter unit and wherein the locating device has a computer unit, a receiver unit, and a transmitter unit.

* * * * *